United States Patent [19]

Scott

[11] Patent Number: 4,623,089

[45] Date of Patent: Nov. 18, 1986

[54] PUNCHING MACHINE WITH SELECTIVELY ACTUATABLE PUNCHES

[75] Inventor: William B. Scott, Rochelle, Ill.

[73] Assignee: W. A. Whitney Corp., Rockford, Ill.

[21] Appl. No.: 732,914

[22] Filed: May 13, 1985

[51] Int. Cl.[4] ..... B26F 1/04

[52] U.S. Cl. ..... 234/114; 234/116; 83/571; 83/698

[58] Field of Search ..... 234/114–116; 83/571, 572, 698

[56] References Cited

U.S. PATENT DOCUMENTS

| | | | |
|---|---|---|---|
| 1,856,175 | 5/1932 | Towle | 83/572 |
| 3,263,914 | 8/1966 | Huber | 234/114 X |
| 3,738,569 | 6/1973 | Killaly | 234/115 X |
| 4,480,782 | 11/1984 | Morishima | 83/571 X |

FOREIGN PATENT DOCUMENTS

| | | | |
|---|---|---|---|
| 2227182 | 11/1974 | France | 234/116 |

OTHER PUBLICATIONS

Brochure (2 pages) entitled *Trumpf Multitool,* published at least as early as Sep., 1983.

*Primary Examiner*—James M. Meister

*Attorney, Agent, or Firm*—Leydig, Voit & Mayer, Ltd.

[57] ABSTRACT

A punch holder is detachably connected to the lower end of a vertically reciprocable ram and carries a plurality of differently shaped punches which are supported to slide upwardly and downwardly in the holder. Individual actuators are operably associated with the punches and selectively activate one or more punches during any given punching stroke of the ram so that either one hole or multiple holes may be punched during such stroke.

4 Claims, 9 Drawing Figures

PUNCHING MACHINE WITH SELECTIVELY ACTUATABLE PUNCHES

BACKGROUND OF THE INVENTION

The invention relates to a machine for punching holes in a workpiece and, more particularly, relates to a punch press of the type in which a punch holder is detachably connected to the lower end of a vertically reciprocable ram and carries a punch which forms the hole when the ram is advanced downwardly.

To increase the tool place capacity of the press, certain tool holders carry multiple punches which may be activated selectively. Thus, one punch of the holder may be activated during one punching stroke of the ram in order to form a hole of one size and shape while another punch of the holder may be activated during a subsequent punching stroke to form a hole of a different size and/or shape. In prior commercially available holders of the foregoing type, only one of the multiple punches may be activated for any given stroke.

SUMMARY OF THE INVENTION

The general aim of the present invention is to provide a new and improved punching machine having a unique punch holding and actuating system which permits one or more punches to be activated during any given stroke of the ram so that either one hole or multiple holes may be punched during such stroke.

A further object of the invention is to provide a system capable of storing multiple punches of widely varying sizes and capable of applying balanced punching forces to such punches in spite of the wide variation in size.

A more detailed object is to achieve the foregoing by providing individual actuators for controlling activation of the individual punches in the holder, each actuator being capable of activating its associated punch independently of the other punches so that either one punch or multiple punches may be activated when the ram advances through a punching stroke.

The invention also resides in the unique arrangement of punch activating rods to enable the punch holder to be coupled to and uncoupled from the rods when the holder is moved sidewise of the ram.

These and other objects and advantages of the invention will become more apparent from the following detailed description when taken in conjunction with the accompanying drawings.

DETAILED DESCRIPTION OF THE PREFERRED EMBODIMENTS

Figure 1:
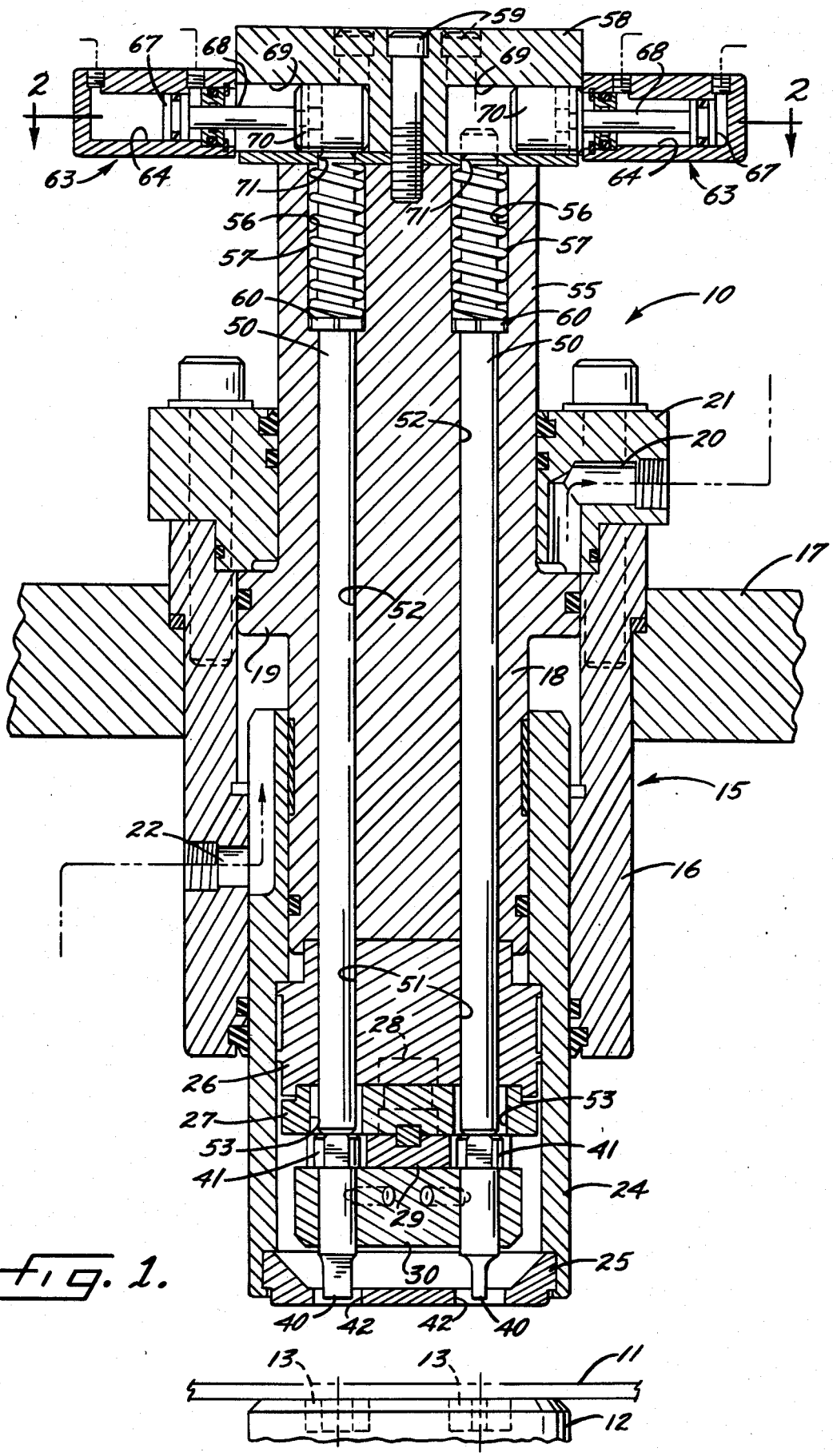
FIG. 1 is a fragmentary cross-sectional view taken vertically through a new and improved punch press incorporating the unique features of the present invention, the view being taken substantially along the line 1—1 of FIG. 2 and showing the ram of the press in an upwardly retracted position.

As shown in the drawings for purposes of illustration, the invention is embodied in a punching machine in the form of a hydraulically operated punch press 10 for punching holes in a workpiece 11 which herein has been shown as being a flat metal sheet. The workpiece overlies a die holder 12 which, in the present instance, supports four dies 13 of different shapes located at the corners of an imaginary rectangle, two of the dies being visible in FIG. 3.

The punch press 10 includes a hydraulic actuator 15 (FIG. 1) comprising a cylinder 16 which is fixed to a main frame member 17. Slidable upwardly and downwardly within the cylinder is a vertically elongated ram 18 which carries a piston 19. When pressure fluid is admitted into the upper end of the cylinder via a port 20 in an upper cylinder cap 21, the ram is advanced downwardly through a punching stroke. Upward retraction of the ram is effected when pressure fluid is admitted into the lower end of the cylinder by way of a port 22. The ram may be held precisely oriented in a fixed angular position by a mechanism similar to that disclosed in Scott et al U.S. Pat. No. 3,939,748.

Telescoped slidably into the cylinder 16 and over the ram 18 is a stripper housing 24 whose lower end carries a stripper plate 25. The latter engages the workpiece 11 during the downward stroke of the ram and holds the workpiece downwardly against the die holder 12 when the ram is retracted upwardly. Reference may be made to Brolund et al U.S. Pat. No. 3,722,337 for a detailed disclosure of the manner of actuating the stripper.

Figure 4:
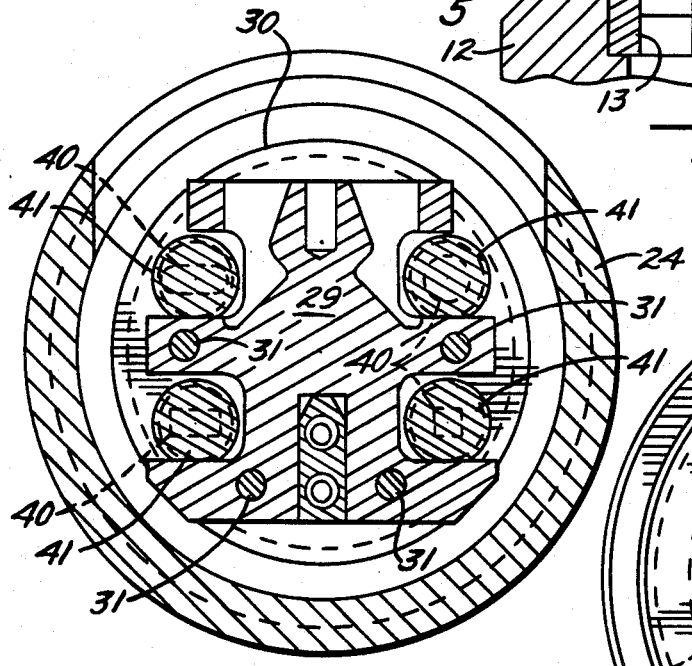
FIGS. 4 and 5 are cross-sections taken substantially along the lines 4—4 and 5—5, respectively of FIG. 3.
Figure 5:
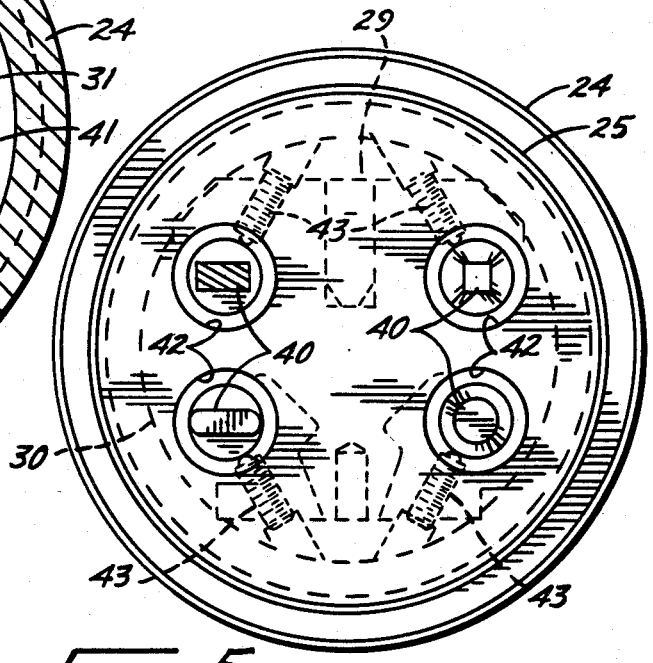
Figure 6:
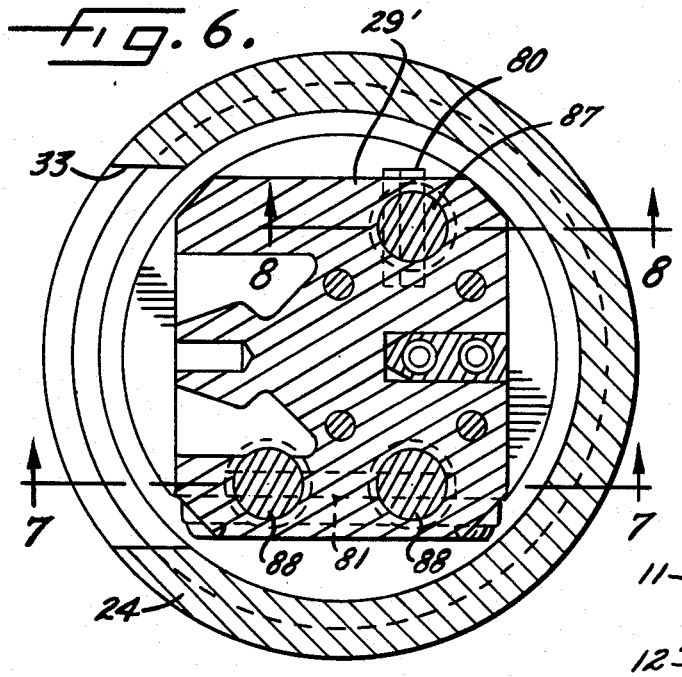
FIG. 6 is a cross-sectional view showing a different type of punch holder, the view being taken substantially along the line 6—6 of FIG. 7.

Adaptors 26 and 27 are located within the stripper housing 24 and are secured rigidly to the lower end of the ram 18. The adaptors are formed with openings shaped to receive a shank 28 projecting upwardly from a spider 29 whose lower end carries a punch holder 30, the spider being connected to the punch holder by screws 31 (FIG. 4).

Figure 7:
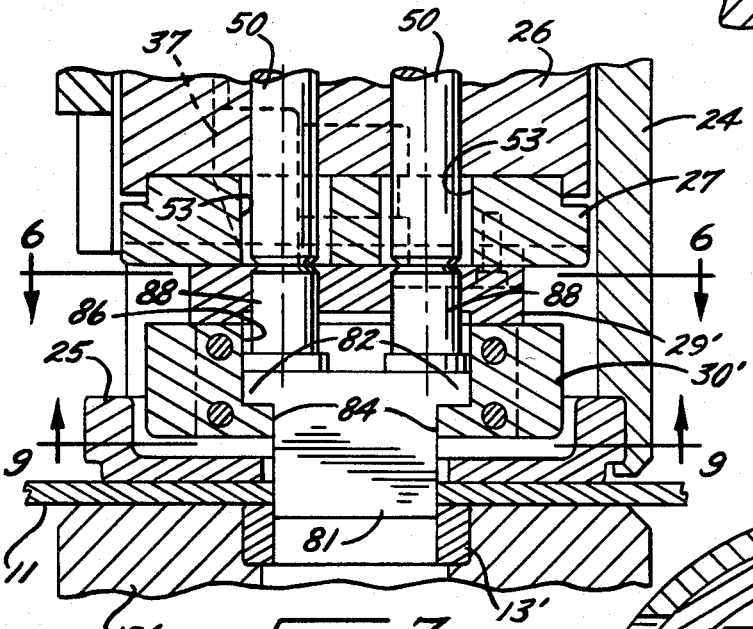

The spider 29 and the punch holder 30 are adapted to be inserted radially into the stripper housing 24 by way of a window 33 (FIG. 4) formed in the wall of the housing. In addition, the shank 28 of the spider is adapted to be inserted radially through slots (not visible) formed in the sides of the adaptors 26 and 27. After the shank has been located in the adaptors, a vertically reciprocable wedge 35 (FIG. 7) is advanced downwardly to clamp the shank within the adaptors. Brolund U.S. Pat. No. 4,485,549 discloses a locking wedge similar to the wedge 37 and also discloses one method by which the punch holder 30 with the spider 29 may be inserted radially into and removed radially from the adaptors 26 and 27. An automatic method of changing the punch holder is disclosed in Scott U.S. application Ser. No. 647,122, filed Sept. 4, 1984 and assigned to the assignee of the present invention.

In the embodiment shown in FIGS. 1 to 5, the punch holder 30 supports four punches 40 which are of different shapes. For example, and referring to FIG. 5, one of the punches may be round, another one oval, the third punch rectangular and the remaining punch square. Each punch is supported to slide upwardly and downwardly in the punch holder and includes an upper head 41 which engages the upper side of the punch holder to limit downward movement of the punch in the holder. The punches project downwardly through holes 42 in the stripper plate 25 and are alined vertically with the dies 13, the cavities of the dies corresponding in shape to the punches. Spring-loaded plungers 43 (FIG. 5) in the punch holder 30 frictionally engage the shanks of the punches to prevent the punches from falling out of the holder if the latter is inverted.

In accordance with the present invention, any selected number of punches 40 may be activated during any given punching stroke of the ram 18 in order to enable as many as four holes of different shapes to be formed during such punching. If the workpiece 11 does not require all four types of holes at the particular points which underlie the punches during the punching stroke, one, two or three of the punches may be selectively de-activated to cause the formation of only those holes which are in fact required. Thus, the arrangement of the invention possesses essentially all of the advantages of a cluster punch but, at the same time, enables any number of non-required punches to be selectively de-activated as dictated by the hole pattern being formed.

More specifically, the punches 40 are activated and de-activated by the action of four punch rods 50 which are mounted for up and down sliding in vertically extending holes 51 (FIG. 1) formed in the adaptor 26 and in vertically extending bores 52 formed in the ram 18. The punch rods are disposed in vertical alinement with the four punches 40 and directly overlie the heads 41 of the punches. The lower end portions of the punch rods extend downwardly into holes 53 (FIG. 3) formed in the adaptor 27, the holes 53 being sufficiently large to receive the punch heads 41.

As shown in FIG. 1, the ram 18 includes an extension 55 which projects upwardly from the cylinder cap 21. The upper end portions of the punch rods 50 are located within counterbores 56 formed in the extension 55 at the upper end of the bores 52. Coil springs 57 are telescoped into the counterbores and over the upper end portions of the punch rods and are positioned with their upper ends engaging an upper block 58 which is secured to the upper end of the ram extension 55 by screws 59. The lower ends of the springs engage shoulders defined by split rings 60 which are contracted tightly into annular grooves formed around the upper end portions of the punch rods. Thus, the springs urge the rods downwardly and normally cause the rings 60 to seat against the bottom of the counterbores 56 to limit downward movement of the rods beyond the position shown in FIG. 1. When the rods are so positioned, their lower ends are precisely flush with the lower end of the adaptor 27. As a result, the rods do not project downwardly beyond the adaptor 27 and interfere with sidewise changing of the spider 29 and the punch holder 30 and, at the same time, the rods normally prevent the punch heads 41 from dowelling upwardly into the holes 53 in the adaptor 27 and interfering with such sidewise changing.

Figure 2:
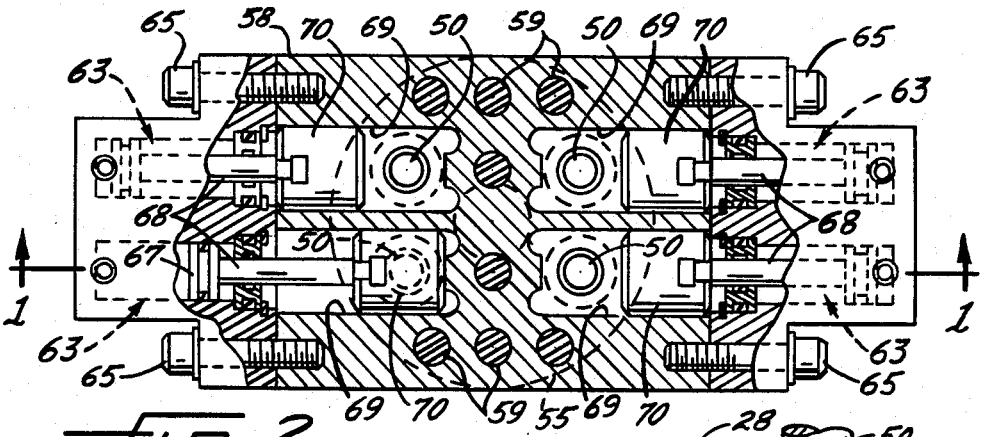
FIG. 2 is a fragmentary cross-section taken substantially along the line 2—2 of FIG. 1.

Pursuant to the invention, provision is made of four individual actuators 63 (FIGS. 1 and 2) for selectively controlling downward and upward movement of the individual rods 50 and thus for selectively controlling activation and de-activation of the individual punches 40. In the present instance, each actuator is a reciprocating hydraulic actuator and includes a cylinder 64 (FIG. 1) attached to the outer side of the block 58 by screws 65 (FIG. 2), there being two cylinders on each laterally facing side of the block. A piston 67 (FIG. 1) is adapted to reciprocate within each cylinder and carries a rod 68 whose inner end projects into a laterally extending hole 69 in the block. Secured rigidly to the inner end of each rod is a block-like stop 70 adapted to reciprocate within the hole 69 between active and inactive positions when the rod 68 is advanced and retracted. In FIG. 1, the left-hand stop 70 has been shown in its active position while the right-hand stop has been shown in its inactive position. In FIG. 2, the remaining two stops 70 also have been shown in their inactive positions. When the stops are in their active positions, they block holes 71 (FIG. 1) formed in the lower side of the block 58 and alined vertically with the counterbores 56. When the holes 71 are blocked by the stops, the upper ends of the punch rods 50 engage the stops and thus the punch rods are prevented from moving upwardly. When the stops 70 are in their inactive positions, the upper end portions of the punch rods 50 are free to move upwardly through the holes 71 and into the holes 69 as shown by the phantom line illustration of the right-hand punch rod in FIG. 1.

With the foregoing arrangement, the springs 57 urge the punch rods 50 downwardly and cause the lower end portions of the rods to bear against the heads 41 of the punches 40. Accordingly, all four punches extend downwardly from the punch holder 30 and project into the stripper plate 25 to punching positions when the ram 18 is in its retracted position as shown in FIG. 1.

Figure 3:
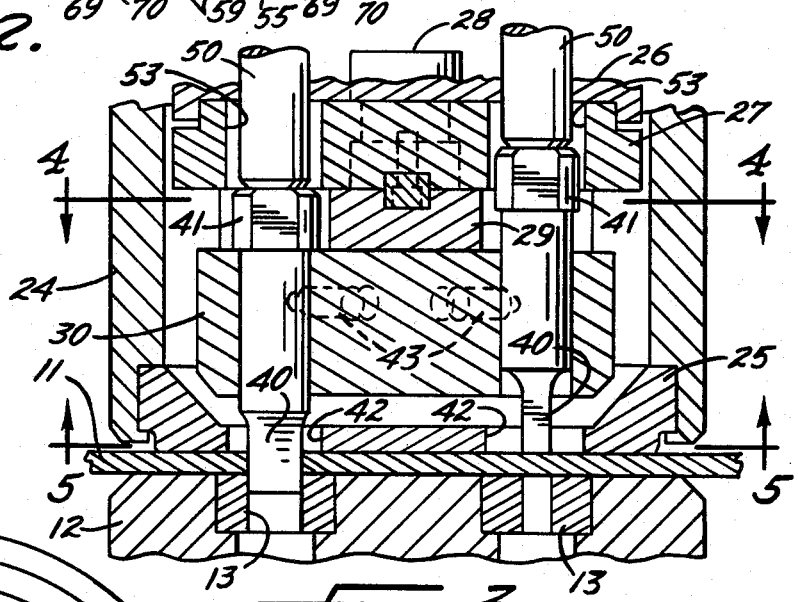
FIG. 3 is an enlarged view of certain parts illustrated in FIG. 1 and shows the ram in a downwardly advanced position.

When the ram 18 is advanced downwardly, the lower ends of all four punches 40 engage the upper side of the workpiece 11 (see FIG. 3). Only the punch or punches that are activated, however, actually pierce the workpiece as indicated by the left-hand punch in FIG. 3. With respect to that punch, the associated stop 70 is disposed in the active position and blocks upward movement of the punch rod 50 so that the punch rod forces the punch downwardly through the workpiece as the ram completes its downward stroke. The inactivated punch or punches, however, assume a non-punching position relative to the punch holder 30 as exemplified by the right-hand punch shown in FIG. 3. When that inactivated punch engages the upper side of the workpiece, its associated stop 70 is retracted to its inactive position uncovering the hole 71. Thus, upon downward movement of the ram 18, the inactive punch engages and simply stops against the workpiece and, as the ram continues downwardly, the block 58 moves downwardly relative to the stopped punch rod 50 as permitted by the open hole 71. In addition, the punch holder 30 and the adaptor 27 move downwardly relative to the stopped punch as permitted by the slidably mounted punch and by the enlarged hole 53 in the adaptor. During such relative movement, the spring 57 compresses and then forces the punch rod 50 and the punch 40 downwardly when the ram is subsequently retracted.

Operation of the actuators 63 may be controlled by programmed commands from a computerized numerical control or the like. Thus, either one, two, three or four actuators may be operated to advance the stops 70 to the active position during the punching stroke of the ram 18. In this way, as few as one or as many as four holes may be formed during any given stroke. Thus, the present system adds significant flexibility to the programming.

A modified punch holder 30' for use with the press 10 is shown in FIGS. 6 to 9 in which parts corresponding to parts of the first embodiment have been indicated by the same but primed reference numerals. The punch holder 30' carries two parting punches 80 and 81 for punching narrow slots in the workpiece 11 so as to separate portions of the workpiece from one another.

Figure 8:
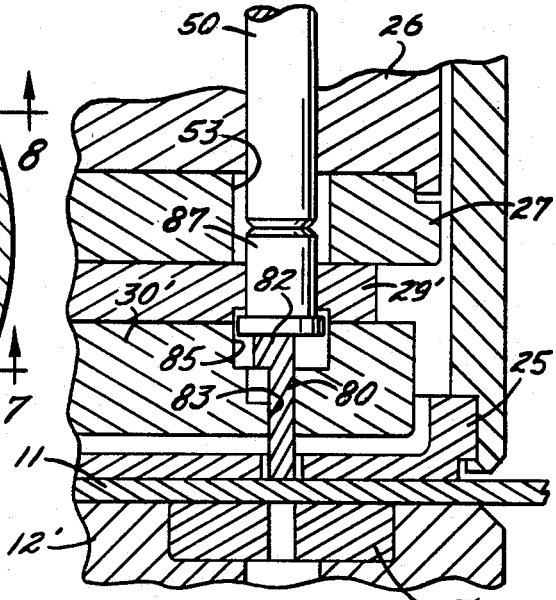
FIGS. 7 and 8 are fragmentary cross-sections taken substantially along the lines 7—7 and 8—8, respectively, of FIG. 6.
Figure 9:
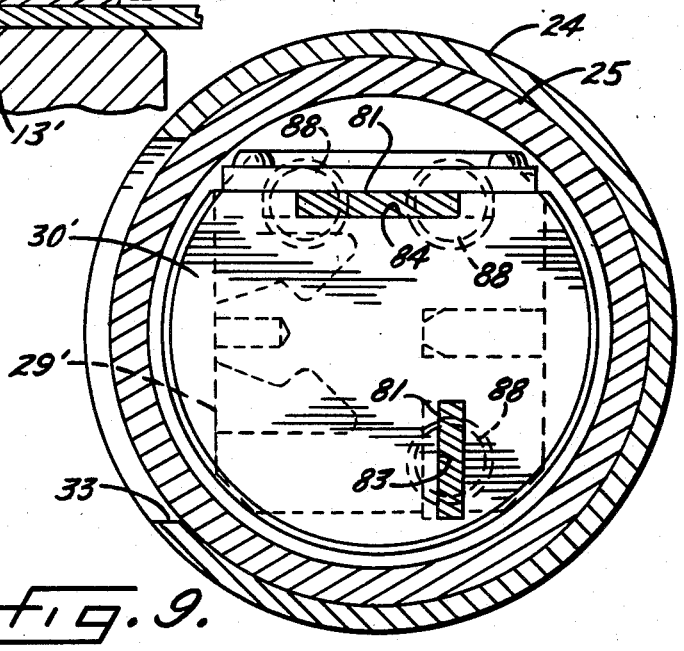
FIG. 9 is a cross-section taken substantially along the line 9—9 of FIG. 7.

Each of the punches 80 and 81 is substantially rectangular in cross-section and each includes a crosshead 82 (FIGS. 8 and 9). The punch 80, however, is substantially narrower in width than the punch 81.

As shown in FIGS. 8 and 9, the punches 80 and 81 are slidably received in slots 83 and 84, respectively, in the punch holder 30', there being enlarged openings 85 and 86 at the upper ends of the slots for receiving the heads 82 of the punches 80 and 81, respectively. The opening 85 receives a driver 87 (FIGS. 6 and 8) having a flanged lower end engaging the head 82 of the narrow punch 80 and having an upper end portion disposed slidably in the spider 29'. The driver 87 is alined vertically with one of the punch rods 50 and is formed separately of the punch 80.

Two similar drivers 88 (FIGS. 6 and 7) are received within the opening 86 and are spaced from one another so as to engage the head 82 of the wide punch 81. The upper end portions of the drivers 88 project slidably into the spider 29' and are alined vertically with two of the punch rods 50.

By virtue of the foregoing arrangement, the punch 80 may be activated by blocking movement of the overlying punch rod 50 to prevent the driver 87 from moving within the hole 53. Similarly, the punch 81 may be activated by blocking the pair of overlying rods 50 to stop movement of the drivers 88 within the holes 53. Even though the vertical centerline of the wide punch 81 is not alined with the axis of either punching rod, the use of the two drivers 88 enables balanced forces to be applied to the punch during the punching stroke.

I claim:

1. A machine for punching holes in a generally horizontal workpiece, said machine comprising a punch holder, a vertically elongated ram having lower end means detachably connected to said punch holder, said punch holder being movable into and out of said lower end means in a direction extending transversely of said ram, said ram being operable to advance the holder downwardly toward and retract the holder upwardly away from the workpiece, a plurality of punches mounted in the holder to slide downwardly and upwardly relative to the holder between punching and non-punching positions, said punches normally being disposed in said punching positions and projecting downwardly from said holder to engage the upper side of the workpiece when the holder is advanced downwardly toward the workpiece, means selectively operable to hold each punch downwardly in its punching position or to permit such punch to slide upwardly relative to the holder to its non-punching position when the punch initially engages the workpiece, said means comprising a plurality of vertically extending rods supported within said ram to slide downwardly and upwardly in the ram, there being a rod associated with each punch, each rod normally being positioned to limit upward movement of its associated punch relative to the holder and hold said punch in its punching position, each rod being slidable upwardly relative to the ram to permit the associated punch to slide upwardly relative to the holder to its non-punching position, downwardly opening holes in said lower end means of said ram and receiving the upper end portions of said punches when the punches are in said non-punching position, means for normally keeping the lower ends of said rods flush with the lower ends of said holes whereby said rods normally prevent the upper end portions of said punches from entering said holes and normally enable said punch holder and the punches therein to be moved into and out of said lower end means of said ram in a direction extending transversely of said ram without interference from either said rods or said punches, and individual actuators associated with the individual rods and each individually operable to permit or prevent upward movement of the associated rod.

2. A machine as defined in claim 1 further including stops slidable transversely of said rods between active positions overlying the upper ends of the rods and inactive positions spaced transversely of the upper ends of the rods, said actuators being selectively operable to move said stops between said active and inactive positions.

3. A machine as defined in claim 1 further including drivers mounted for up and down sliding in said punch holder and alined vertically with said rods, said drivers being located between said punches and said rods, there being two drivers associated with at least one of said punches and located on opposite sides of the vertical centerline of such punch.

4. A machine for punching holes in a generally horizontal workpiece, said machine comprising a punch holder, a vertically elongated ram having a lower end detachably connected to said punch holder and operable to advance the holder downwardly toward and retract the holder upwardly away from the workpiece, a plurality of punches mounted in the holder to slide downwardly and upwardly relative to the holder between punching and non-punching positions, said punches normally being disposed in said punching positions and projecting downwardly from said holder to engage the upper side of the workpiece when the holder is advanced downwardly toward the workpiece, means selectively operable to hold each punch downwardly in its punching position or to permit such punch to slide upwardly relative to the holder to its non-punching position when the punch initially engages the workpiece, said means comprising a plurality of vertically extending rods supported within said ram to slide downwardly and upwardly in the ram, there being a rod associated with each punch, each rod normally being positioned to limit upward movement of its associated punch relative to the holder and hold such punch in its punching position, each rod being slidable upwardly relative to the ram to permit the associated punch to slide upwardly relative to the holder to its non-punching position, drivers mounted for up and down sliding in said punch holder and alined vertically with said rods, there being two drivers associated with at least one of said punches and located on opposite sides of the vertical centerline of such punch, and individual actuators associated with the individual rods and each individually operable to permit or prevent upward movement of the associated rod.

* * * * *